US007549529B2

(12) United States Patent
Dreisbach et al.

(10) Patent No.: US 7,549,529 B2
(45) Date of Patent: Jun. 23, 2009

(54) PALLET-TYPE CONVEYOR SYSTEM FOR HOT METAL-STRIP COILS

(75) Inventors: Günther Dreisbach, Hilchenbach (DE); Bernd-Uwe Fingerle, Hilchenbach (DE); Bernd Büdenbender, Netphen (DE); Bernd Klein, Hilchenbach (DE); Jürgen Peschke, Netphen (DE)

(73) Assignee: Siemag GmbH, Netphen (DE)

( * ) Notice: Subject to any disclaimer, the term of this patent is extended or adjusted under 35 U.S.C. 154(b) by 501 days.

(21) Appl. No.: 11/334,784

(22) Filed: Jan. 18, 2006

(65) Prior Publication Data

US 2006/0157434 A1 Jul. 20, 2006

(30) Foreign Application Priority Data

Jan. 19, 2005 (DE) ..... 10 2005 002 661
Dec. 14, 2005 (DE) ..... 10 2005 060 212

(51) Int. Cl.
*B65D 19/38* (2006.01)

(52) U.S. Cl. ..... 198/465.1; 198/867.11; 198/867.13; 108/55.3; 108/57.31; 108/57.32; 410/49

(58) Field of Classification Search ..... 198/867.11, 198/867.113, 465.1; 108/55.1, 55.3, 57.13, 108/57.31, 57.32; 410/49, 50
See application file for complete search history.

(56) References Cited

U.S. PATENT DOCUMENTS

| | | | | | |
|---|---|---|---|---|---|
| 3,472,363 | A * | 10/1969 | Overton et al. | ..... | 206/597 |
| 3,753,407 | A * | 8/1973 | Tilseth | ..... | 108/53.3 |
| 3,861,659 | A * | 1/1975 | Evenstad | ..... | 266/279 |
| 3,889,831 | A * | 6/1975 | Davis | ..... | 414/433 |
| 5,297,481 | A * | 3/1994 | Robbins et al. | ..... | 100/193 |
| 5,809,907 | A * | 9/1998 | Bumgarner | ..... | 108/51.11 |
| 6,231,284 | B1 * | 5/2001 | Kordel | ..... | 410/49 |
| 6,379,107 | B1 * | 4/2002 | Iwasaki et al. | ..... | 414/809 |
| 6,622,640 | B2 * | 9/2003 | Taylor et al. | ..... | 108/55.5 |
| 6,971,826 | B2 * | 12/2005 | Valentine | ..... | 410/50 |

* cited by examiner

*Primary Examiner*—Mark A Deuble
(74) *Attorney, Agent, or Firm*—Andrew Wilford

(57) ABSTRACT

A conveyor having an array of rollers defining a transport plane is used with pallets each having supports forming an upwardly open saddle adapted to hold a coil of metal strip, and a pair of generally parallel and longitudinally extending rails underneath and fixed to the supports. Each rail has a downwardly directed face adapted to ride directly on the rollers and having a generally planar center region and a pair of upwardly angled end regions each forming a small acute angle with the respective center region.

8 Claims, 9 Drawing Sheets

PALLET-TYPE CONVEYOR SYSTEM FOR HOT METAL-STRIP COILS

FIELD OF THE INVENTION

The present invention relates to a conveyor system. More particularly this invention concerns a pallet-type system for conveying hot metal-strip coils in a steel mill or the like.

BACKGROUND OF THE INVENTION

A mill or treatment plant for metal strip, normally steel, is typically provided with a system for circulating loaded pallets and having multiple roller conveyors. The product, typically a coil of metal strip, is carried on a pallet having two spaced longitudinal running rails and a coil-holding saddle bridging them and forming confronting support faces. The coil is set in the saddle and is transported from the production line where it is rolled and formed into coils to the downstream treatment stations where it may be, for instance, heat treated. The coils are set on and lifted off the pallets, and the empty pallets are recirculated back upstream to the rolling mill for reuse.

Such pallet-circulating systems have been used for a long time for cold coils, that is for coils at the end of a rolling stream producing cold metallic strip, e.g. of aluminum. They can move coils weighing as much as 45 ton and can be quickly recirculated. The advantage of such a system is that the pallets, even though of substantial construction, are still fairly light compared to the massive loads they carry, so that they are easy to move about and position. These pallets are also easy to service, inexpensive to manufacture, and easy to use in general. They allow extremely cumbersome loads that can themselves vary considerably in size and shape to be moved about as if they were all the same.

Such a circulating system using pallets is not suitable for conveying heavy, for example 30 to 40 ton, bundles or coils that are very hot, that is with a surface temperature of the coil between 500° C. and 800° C. In addition to the considerable weight, the considerable heat of the loads being transported causes the pallets to deform substantially, often to the extent of being several millimeters out of shape. The deformations are not uniform, since some parts of the pallets, which are always made of metal, are closer to the hot load or are more directly exposed to the radiant heat emitted by it, so that there is considerable differential expansion.

The main problem is that the lower surface of the pallet defined by its running rails is deformed out of a planar shape. Since these rails ride on arrays of rollers that are all tangent to a normally perfectly horizontal conveyor plane, this means that the pallets do not ride smoothly. Instead of sitting on a plurality of the rollers at any given instant, they sit on only one or two, and bump down the line. This quickly damages the pallet and, when it is carrying a freshly rolled and still very hot coil, the coil itself can be ovalized and made difficult to subsequently unroll and handle. In addition the rollers are subjected to considerable stress, in particular when struck by a corner of an end of a running rail.

OBJECTS OF THE INVENTION

It is therefore an object of the present invention to provide an improved pallet-type conveyor system for hot metal-strip coils.

Another object is the provision of such an improved pallet-type conveyor system for hot metal-strip coils that overcomes the above-given disadvantages, in particular that does not deform when carrying a hot coil in a manner that causes it to ride on the conveyor unevenly or damage the conveyor or its hot load.

SUMMARY OF THE INVENTION

A conveyor having an array of rollers defining a transport plane is used with pallets each having according to the invention supports forming an upwardly open saddle adapted to hold a coil of metal strip, and a pair of generally parallel and longitudinally extending rails underneath and fixed to the supports. Each rail has a downwardly directed face adapted to ride directly on the rollers and having a generally planar center region and a pair of upwardly angled end regions each forming a small acute angle with the respective center region.

Thus according to the invention the rails are shaped so that when subject to normal thermal deformation their ends will not move downward past their centers. Instead the lower rail faces will deform at worst to a generally straight and planar shape. When cold the end regions will be upwardly inclined.

The invention is based on the finite-element method which recognizes that, so that the longitudinal pallet rails remain in good contact with the rollers of the roller conveyers and their ability to roll is not impaired, at least these longitudinal rails are according to the invention constructed so as to take into account the vertical and horizontal deformations likely to occur. An arcing of their running faces and lateral bellying-out or other deformations then have no effect on the running of the pallets, so that the use of the pallet to convey hot coils is possible with no problems.

The shape-compensating formations can be narrowings or cutouts in the running surface, holes in other parts of the pallets, steps or the like, that is formations that allow the pallet to roll easily in spite of the considerable thermal and mechanical stresses it is subject to. In this manner compaction of the hot coil caused by changes in transport speed and sudden stops is avoided, even when the hot coil is conveyed laying flat. It is therefore not necessary to convey the hot coils on end, that is lying flat.

According to the invention a radiant-heat shield is fixed to the pallet between the coil on the saddle and the rails. More particularly the supports are longitudinally spaced on the rails and the shield is between the supports. In addition two more shield plates may be provided that longitudinally flank the supports.

The rollers according to the invention are spaced longitudinally in the plane at a predetermined roller spacing that is less than a longitudinal length of the rail center region. Thus when the pallet is cold and the end regions are canted upward there will be sufficient length for smooth rolling on the conveyor. The end regions extend at substantially less than 30° to the respective center regions.

Each rail according to the invention is comprised of two longitudinally spaced rail sections each having a respective such center region flanked by a pair of the upwardly angled end regions, and respective flexible webs between the rail sections. Thus the rails can flex for smoothest possible rolling.

According to another feature of the invention each rail has between the respective center region and each of the respective end regions an intermediate region forming with the respective center region an angle greater than 0° and smaller than the angle formed by the respective end region with the respective center region. This intermediate region thus forms a smooth transition between the center region and the respective end region.

Each rail in accordance with the invention can be formed by a pair of longitudinally spaced skids each having a respective such center region flanked by a pair of the upwardly angled end regions. The pallet further has according to the invention a frame carrying the supports and respective pivot joints supporting the skids on the frame for pivoting about respective transverse axes.

The pallet further can have according to the invention a frame carrying the supports, respective pivot joints at one longitudinal end of each of the rails for pivoting of the respective rail on the frame about a transverse axis, and respective slide joints at the opposite end of each of the rails for longitudinal sliding of the opposite rail ends on the frame. This allows the rails to get longer when heated without stressing the frame.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
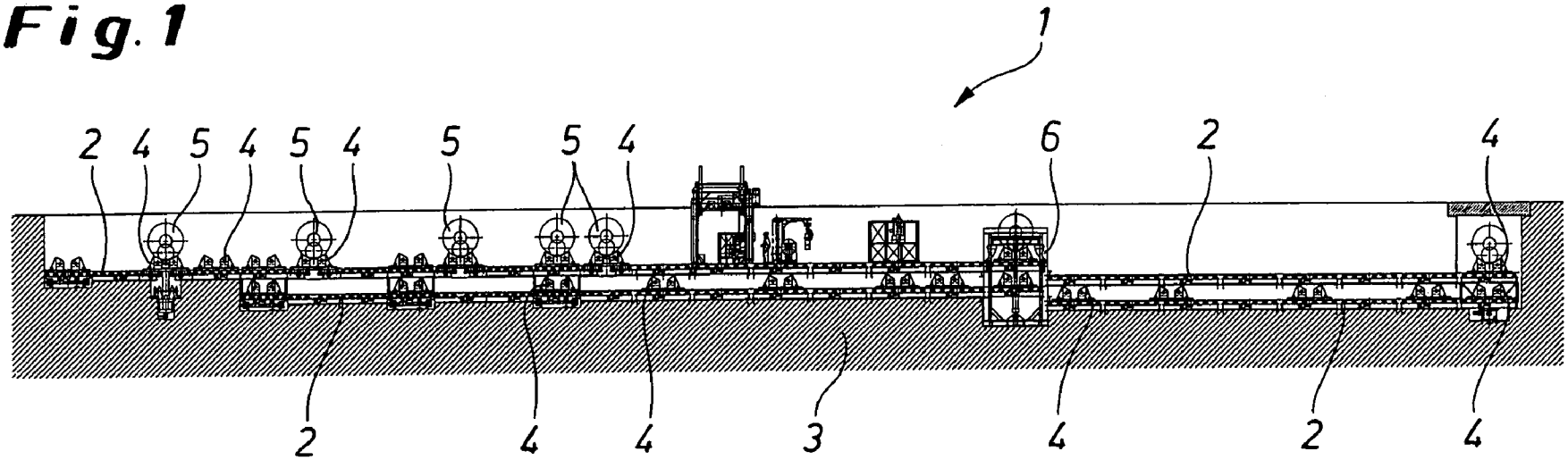
FIG. 1 is a small-scale longitudinal section through a pallet-circulating system for conveying metal coils with roller conveyors at different levels.

As seen in FIG. 1 a rolling mill making metallic strip has a pallet-circulating system 1 having conveyors 2 that are set at different levels above the floor 3. The conveyors 2 move pallets 4 carrying freshly rolled bundles or coils 5 of metal strip and distribute them to any of several unillustrated downstream treatment stations. The coils 5 are heavy, some 450 kN, and vary between 1 m and about 2 m in length, being of generally the same outside diameter as length.

A lift 6 integrated into the conveyors 2 distributes the pallets 4 with their coils 5 to the different levels. This lift 6 as better shown in FIG. 2 serves upper and lower roller arrays 7 for several pallets 4 of which one is shown here with a coil 5. The roller arrays 7 each have a large number of rollers 8 that are driven by a chain 10 from a respective drive motor 9 (see FIG. 3). Each roller array 7 or conveyor 4 defines a horizontal transport plane 17 (see FIG. 4).

Figure 2:
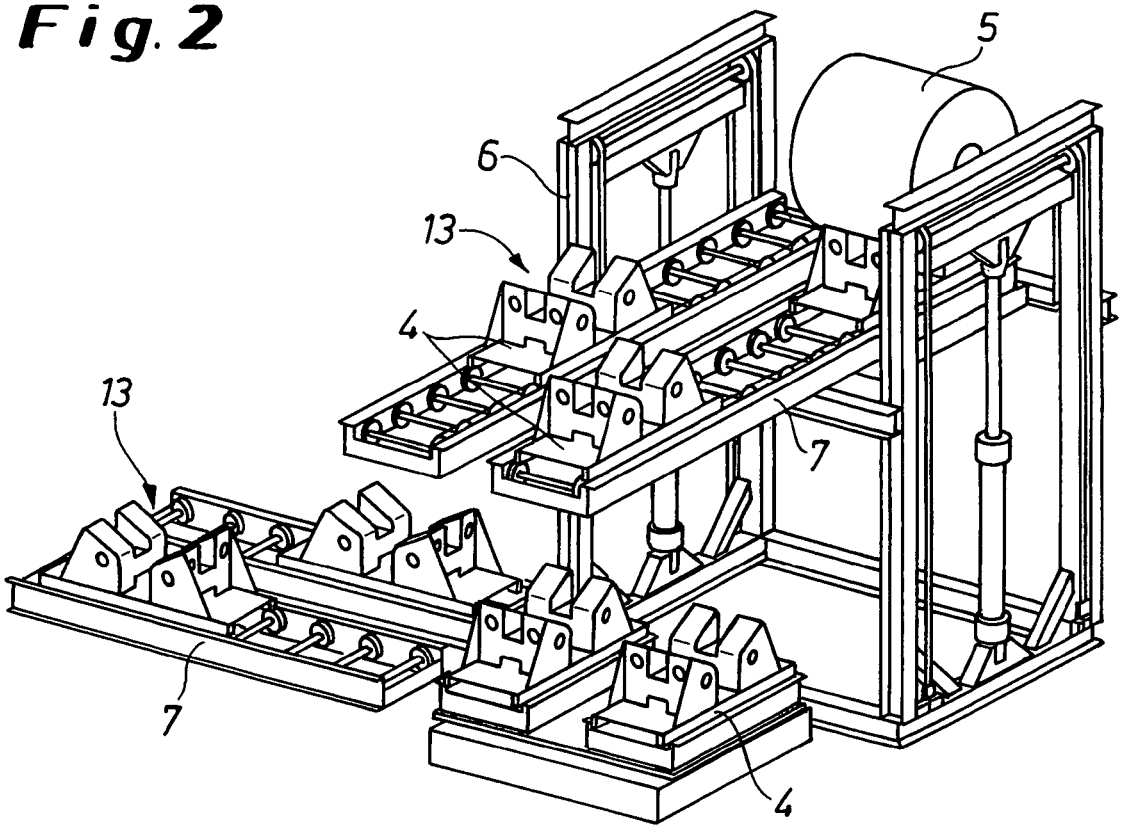
FIG. 2 is a perspective view of a detail of the conveyor system of FIG. 1 showing a lift provided along the conveyors.
Figure 3:
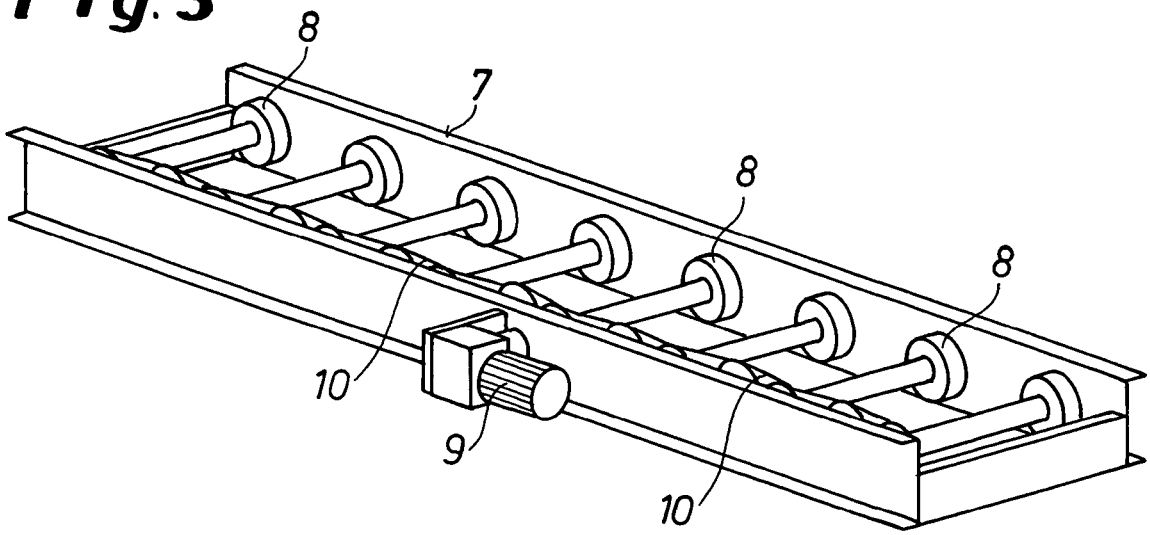
FIG. 3 is a perspective view of a detail of a conveyor of the pallet-circulating system.
Figure 4:
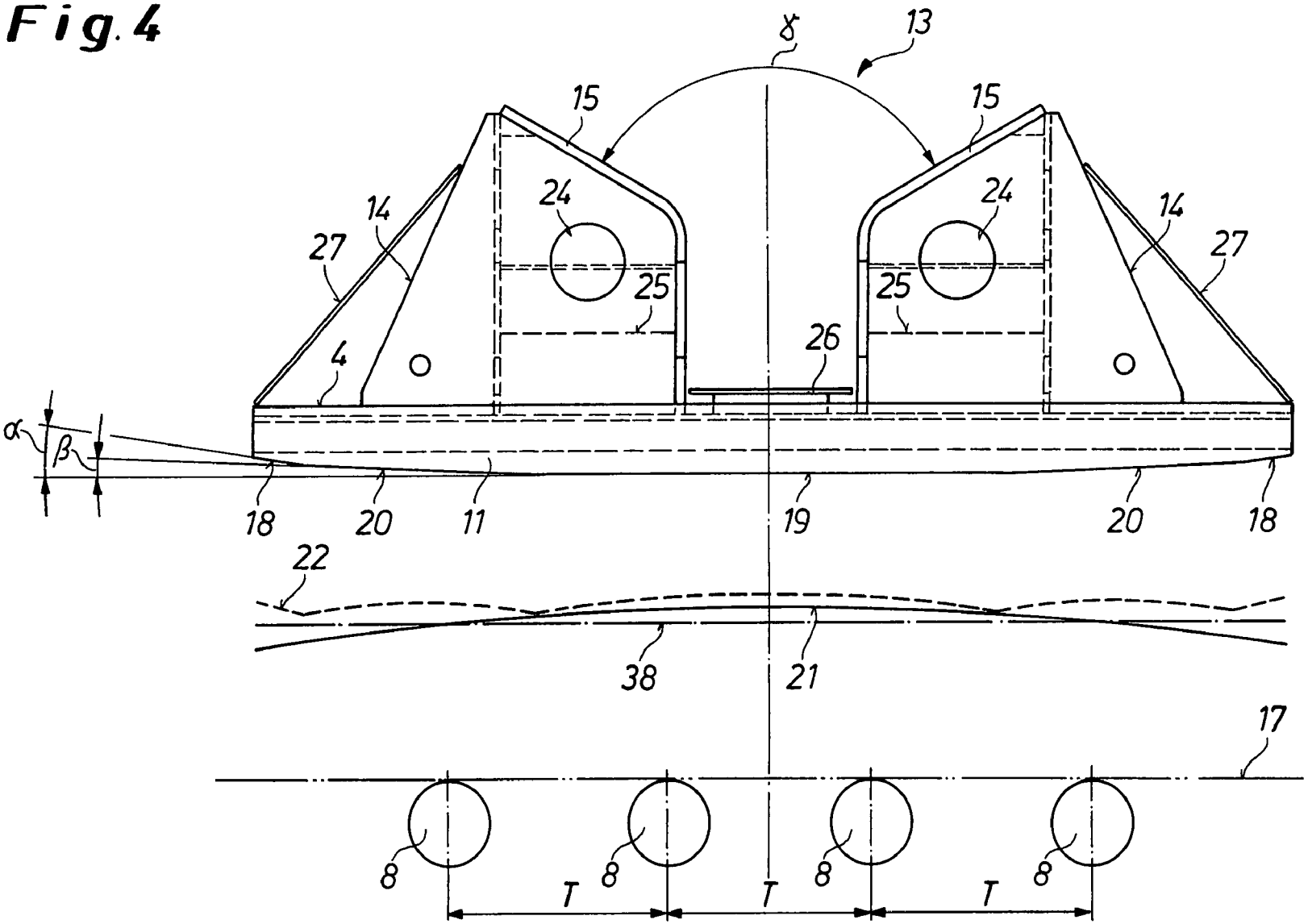
FIG. 4 is a partly schematic side view of a detail of a pallet, the underlying schematically illustrated roller conveyor, and between them the shapes of the longitudinal beams of the pallet shown exaggerated.
Figure 5:
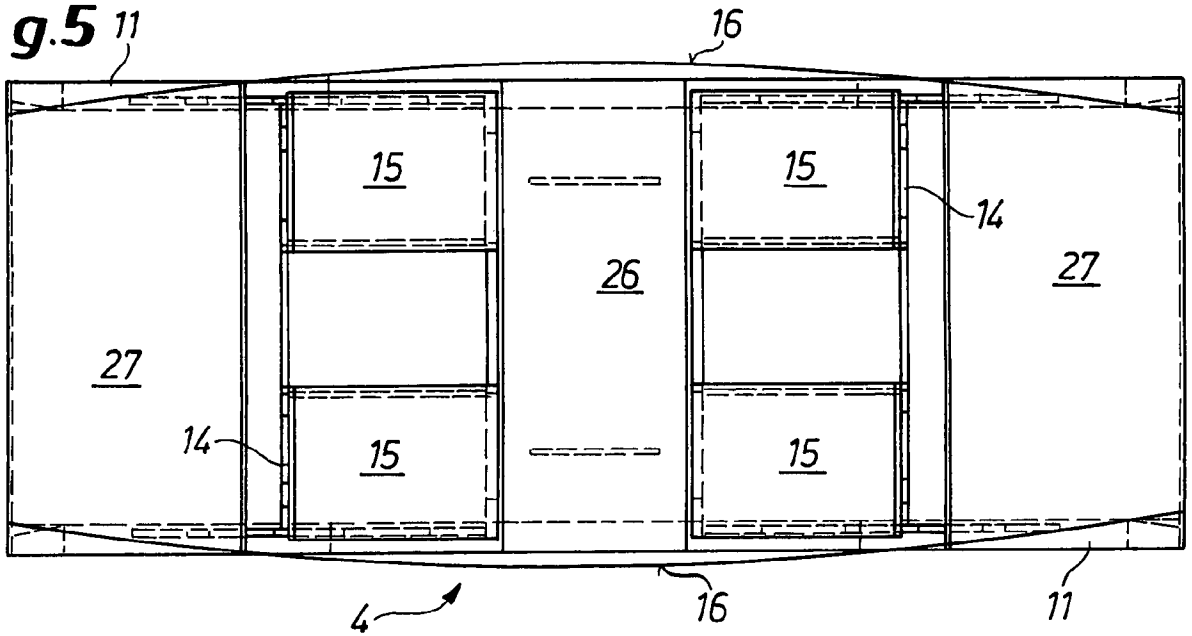
FIG. 5 is a top view of the FIG. 4 pallet.
Figure 6:
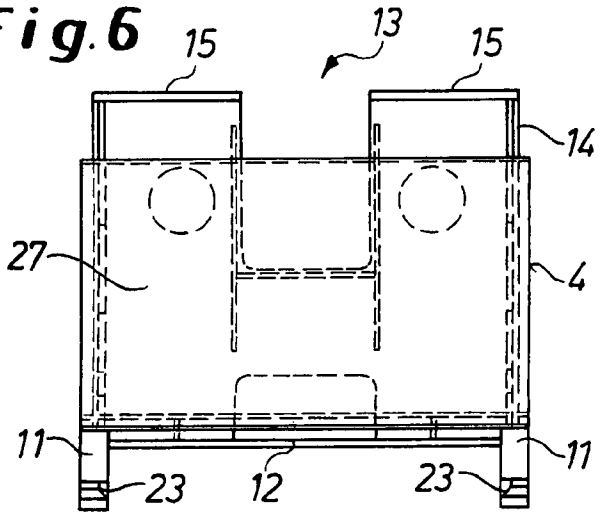
FIG. 6 is an end view of the FIG. 4 pallet.

As shown for example in FIGS. 4, 5, and 6 the pallets 4 are each formed by a pair of parallel spaced longitudinal rails 11 made of steel and spanned by a web plate 12 and a support saddle 13 on which the coil 5 is set (see FIG. 2). The saddle 13 is in turn formed by two longitudinally spaced U-shaped transverse saddle blocks 14 bridging the longitudinal rails 11 and each having two flat upper support faces 15 turned toward the coil 5 and inclined downward and inward. The coil 5 is thus supported by four support faces 15 (see FIG. 5). Opposed support faces 15 form a support angle $\gamma$ that is optimized to fit with the diameters of the coils 5 and that ensures a uniform distribution of vertical and horizontal loads.

The weight of the coil 5 and its heat, transmitted both by conduction through contact with the surfaces 15 and radiantly, will deform the pallet 4. The result is that the longitudinal rails 11 bow upward and belly laterally outward, as shown by the exaggerated side curves 16 in FIGS. 5 and 11 and curve 21 in FIG. 4. Thus the sides of the rails 11 deform outward while the ends of the rails 11 tend to bend downward.

In order that the pallet 4 can continue to ride smoothly on the rollers 8 of the roller arrays 7 of the conveyors 2, the longitudinal rails 11 are provided with compensatory skid-shaped running faces that rise up at end faces 18 from the transport plane 17 (see FIG. 4 and FIG. 10) of the rollers 8 of the roller arrays 7 at an angle $\alpha$. More specifically, in the pallet 4 of FIGS. 4 to 6 between the inclined end faces 18 and a central planar face 19 of each longitudinal rail 11 there are angled faces 20 that form with the transport plane 17 a smaller angle $\beta$ than the angle $\alpha$ of the end faces 18.

The length of the planar central face 19 is greater than a center-to-center spacing T of the rollers 8. When the rails 11 are not shaped like this, they would, under the effects of heat and load shown in FIG. 4, deform directly underneath the pallet 4 as shown by the curve 21 relative to a dot-dash null line 38 representing or parallel to the transport plane 17 and bow upward, that is to be concave downward, with the front and rear ends of the rails 11 moving below the null line 38 of the transport plane 17. With this type of deformation the rail ends would strike against the rollers 8, causing the pallet 4 to move bumpily along, and also damaging the rollers 8.

Here, however, the rails 11 generally have the curved shape shown in FIG. 4 at the exaggerated dotted line 22, according to which angle $\beta$ of the outer end faces 20 moves toward the null line of the plane 17, and together with the deformation of the central planar face 19 produces a very long generally planar running surface facilitating smooth rolling and that in no case extends below the transport plane 17 or null line 38. The angle $\alpha$ of the end faces 18 stays basically the same. In order to compensate for the laterally bellied-out curve 16, the rails 11 are formed with cutouts 23 (see FIG. 6) facing the peripheries of the rollers 8.

In order to compensate for deformation, all embodiments of the pallets 4 have in the transverse saddle blocks 14 of the saddles 13 formations here constituted by transverse and longitudinal bores 24 and 25. To the heat transmission, there are also heat-shield plates 26 and 27. The shields 26 are mounted between the support faces 15 at the base of the saddle 13 above the rails 11. The shields 27 are mounted at the ends of the pallet 4 and set against the saddle blocks 14 having the support faces 15.

Figure 7:
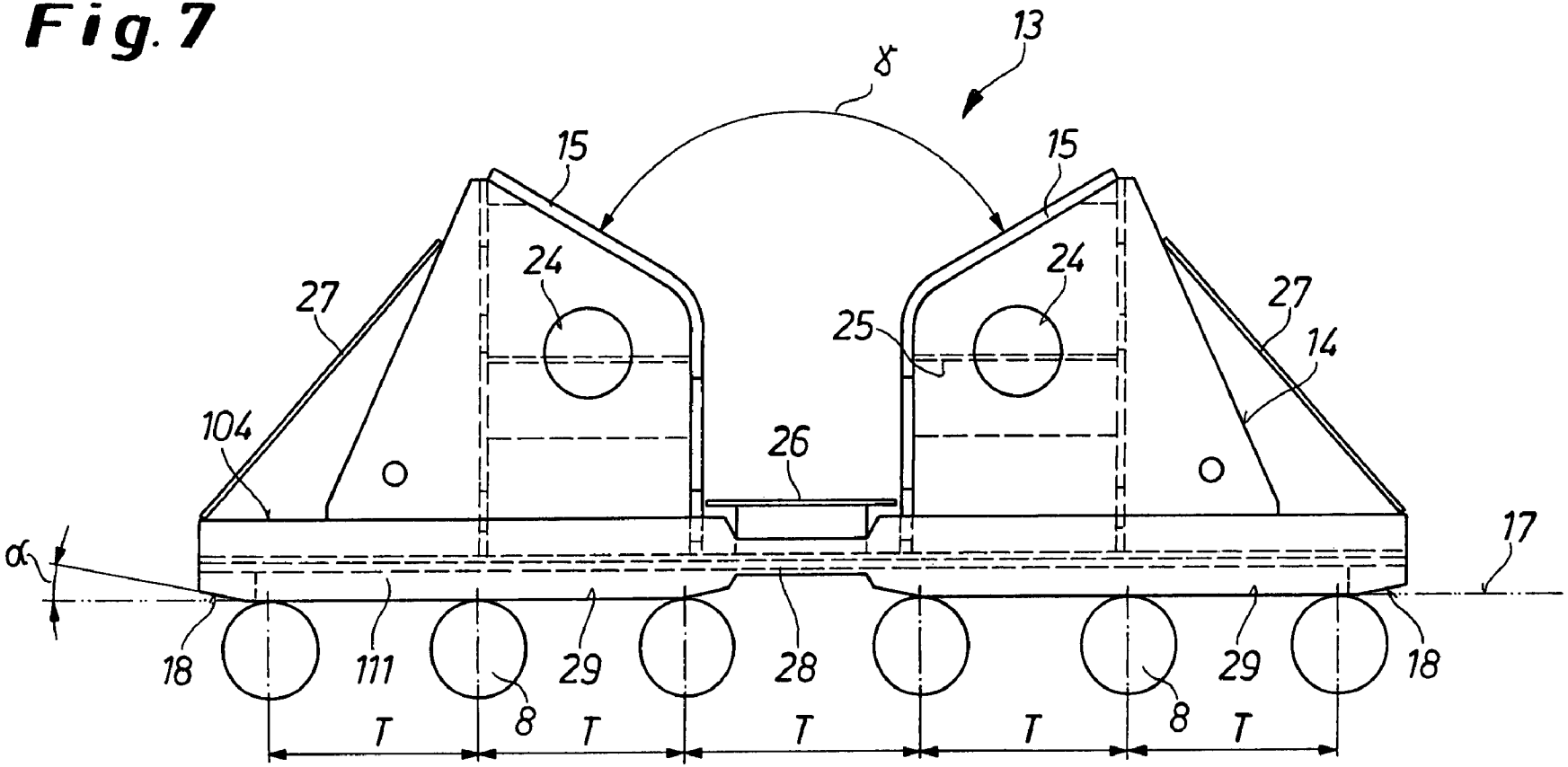
FIG. 7 is a side view of another pallet.

In the pallet 104 of FIG. 7 the longitudinal rails 11 have in addition to the angled end faces extending at angle $\alpha$ between the support faces 15 of the saddle blocks 14 a reduced-section elastically deformable region 28. Running faces 29 between the region 28 and the end faces 28 are substantially planar and have a length equal to a multiple of the spacing T of the rollers 8.

Figure 8:
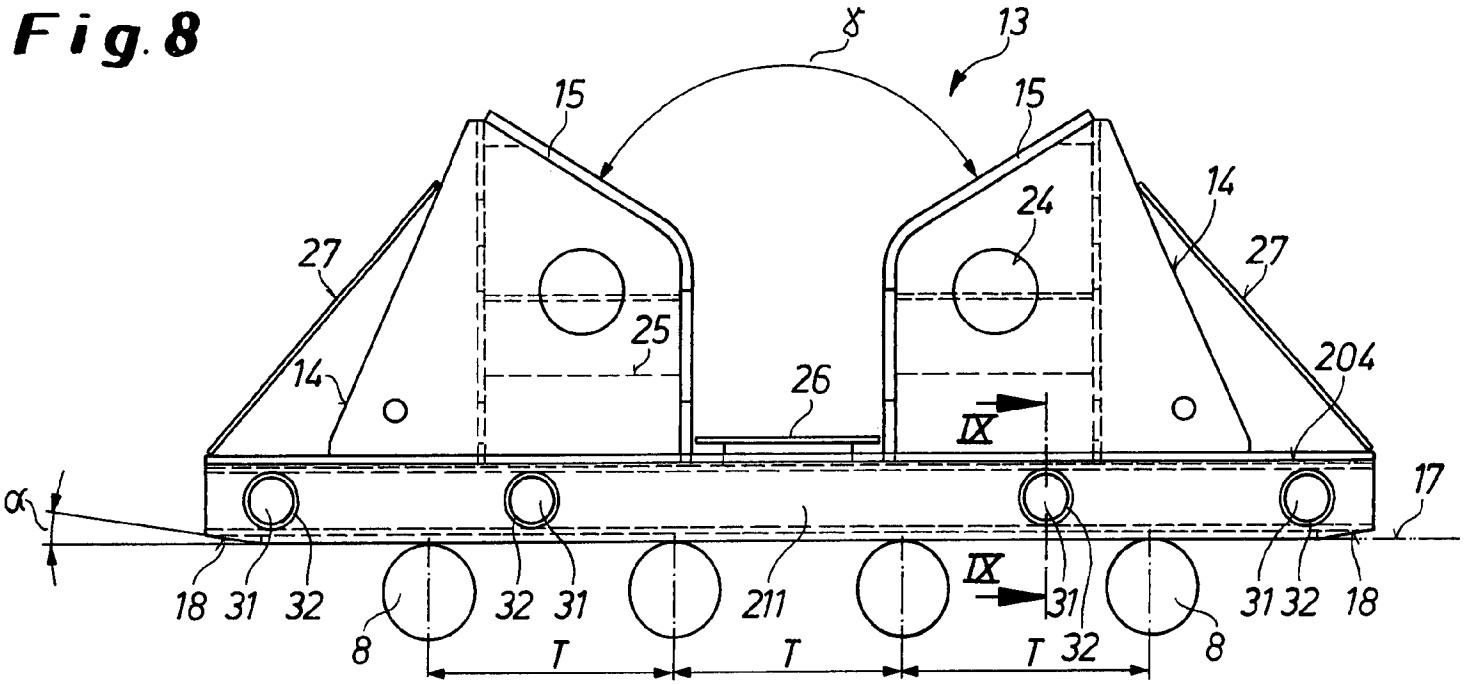
FIG. 8 is a side view of yet another pallet.
Figure 9:
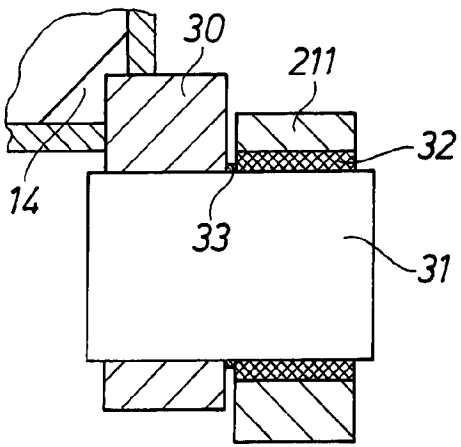
FIG. 9 is a large-scale section through the FIG. 8 pallet taken along section line IX-IX of FIG. 8.

In the pallet 204 of FIGS. 8 and 9 and the pallet 304 of FIGS. 10 to 13 the respective longitudinal rails 211 and 311 having the angled faces 18 are mounted externally on a pallet floor frame 30 (see FIG. 9 and FIGS. 11 to 13). To compensate for thermally and mechanically induced deformations, the longitudinal rails 211 and 311 are mounted on outwardly projecting support bolts 31 via elastic bushings 32 (see FIG. 9). A spacer ring 33 creates a safety space with respect to the floor frame 30 to transversely offset the rails 211 and 311 outward from the frame 30.

Figure 10:
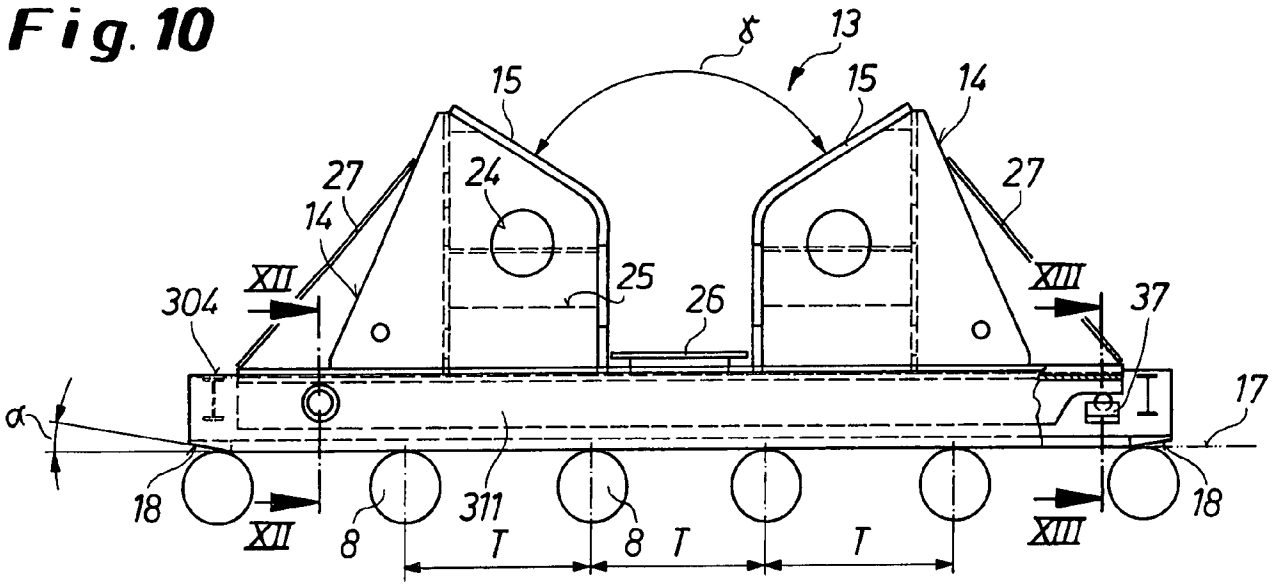
FIG. 10 is a side view of yet another pallet according to the invention.
Figure 11:
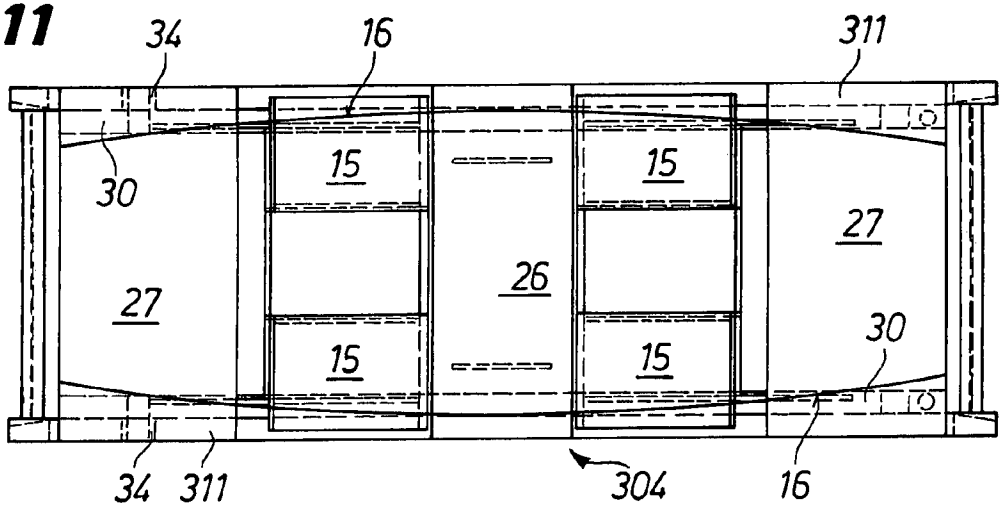
FIG. 11 is a top view of the FIG. 10 pallet.
Figure 12:
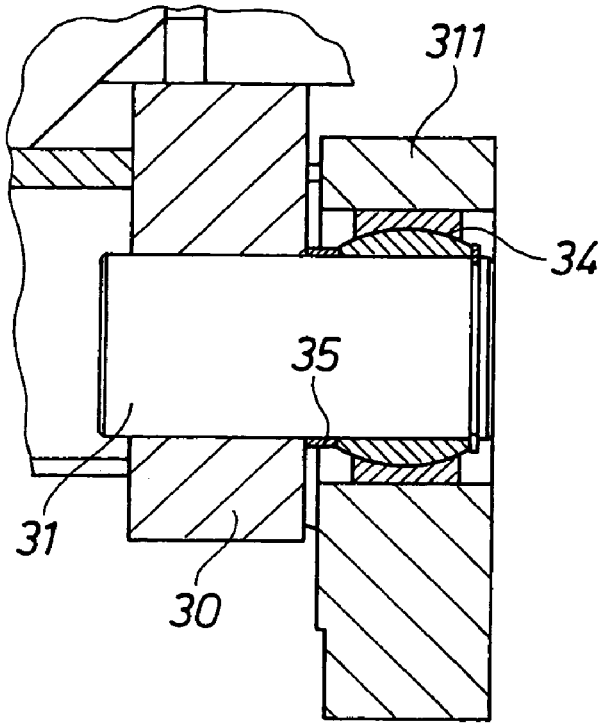
FIGS. 12 and 13 are large-scale sections taken along respective section lines XII-XII and XIII-XIII of FIG. 10.
Figure 13:
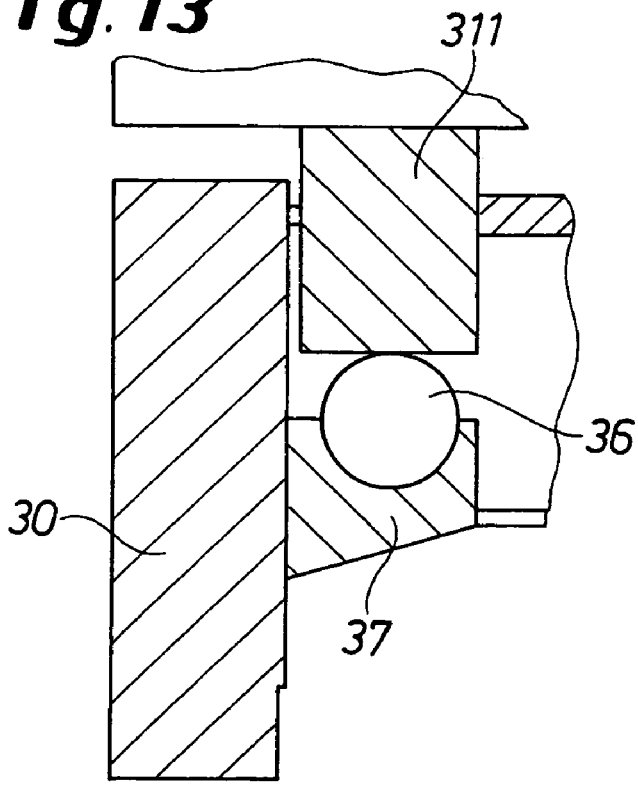

Furthermore, the pallet 304 of FIGS. 10 to 13 is provided on its end shown on the left in FIGS. 10 and 11 with supports for the longitudinal rail 311 constituted by ball-type pivots 34 each having a spacer ring 35 for the floor frame 30 on the support pin 31. On the end on the right pallet side there are loose bearings (see FIG. 13) constituted (see sectional illustration on the right side of FIG. 10) by a saddle-like frame bracket 37 holding a ball or roller 36. Thus the rails 311 in FIGS. 10-13 can pivot about the supports 34 and slide at the supports 36, 37.

Figure 15:
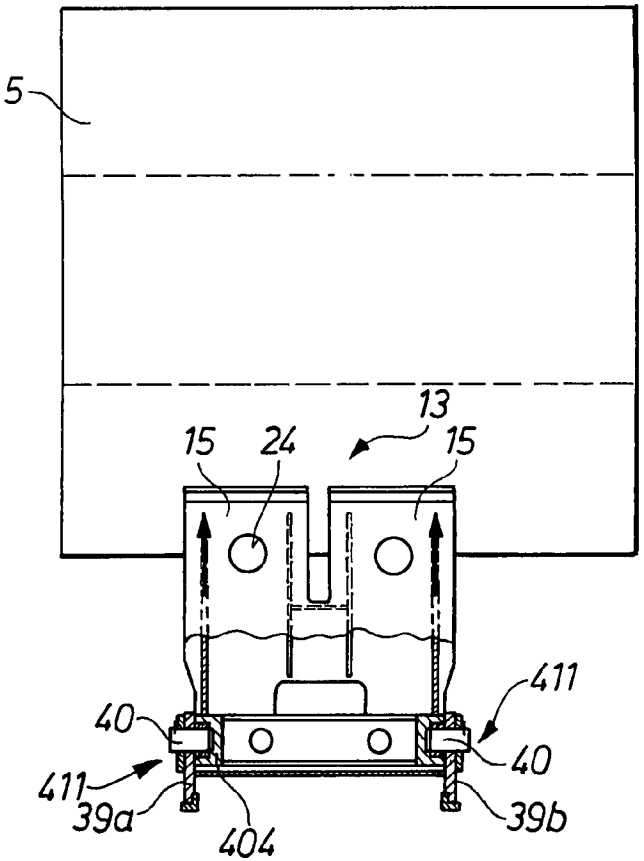
FIG. 15 is the FIG. 14 pallet partly in section and partly in front end view.
Figure 14:
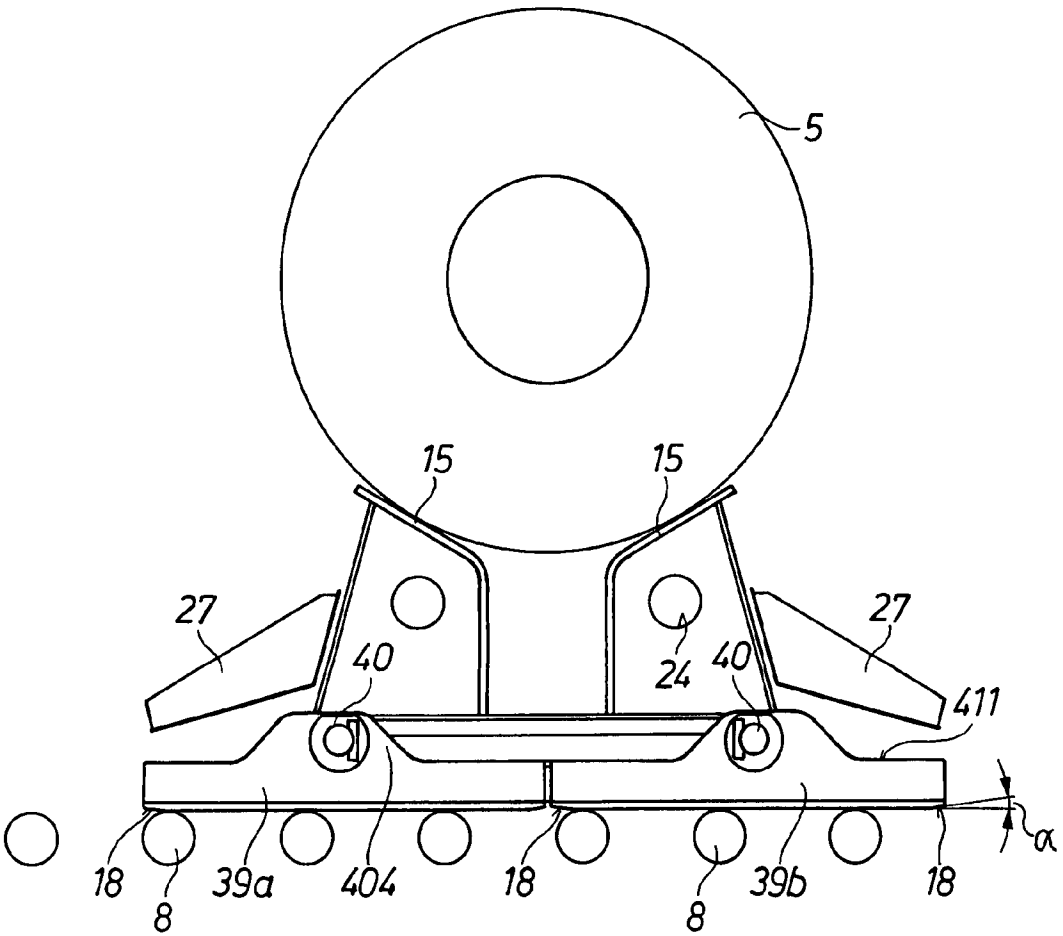
FIG. 14 is a side view of an embodiment of a pallet formed with two movable skids and shown carrying a load.

In the pallet 404 of FIGS. 14 and 15 each of the two longitudinal rails 411 is formed of two separate skids 39*a* and 39*b*. Each skid 39*a* or 39*b* is mounted via a bearing 40 (see FIG. 15) so it can rock independently in the floor frame of the pallet 404 and has angled faces 18 forming the angle $\alpha$ at front and rear ends. Thus the skids 39*a* and 39*b* can rock about respective transverse axes that are located underneath the support faces 15.

We claim:

1. In combination with a conveyor having an array of rollers defining a transport plane, a pallet comprising:

supports forming an upwardly open saddle adapted to hold a coil of metal strip;

a pair of generally parallel and longitudinally extending rails underneath and fixed to the supports, each rail having a downwardly directed face adapted to ride directly on the rollers and having a generally planar center region and a pair of upwardly angled end regions each forming an obtuse angle with the respective center region; and two radiant-heat shields fixed to the pallet between the coil on the saddle and the rails and longitudinally flanking the supports.

2. The pallet defined in claim 1 wherein the supports are longitudinally spaced on the rails and the pallet further comprises a radiant-heat shield fixed to the pallet between the coil on the saddle and the rails and between the supports.

3. The pallet defined in claim 1 wherein the rollers are spaced longitudinally in the plane at a predetermined roller spacing that is less than a longitudinal length of the rail center region.

4. The pallet defined in claim 1 wherein the end regions extend at more than 150° to the respective center regions.

5. In combination with a conveyor having an array of rollers defining a transport plane, a pallet comprising:

supports forming an upwardly open saddle adapted to hold a coil of metal strip; and a pair of generally parallel and longitudinally extending rails underneath and fixed to the supports, each rail having a downwardly directed face adapted to ride directly on the rollers and having a generally planar center region and a pair of upwardly angled end regions each forming an obtuse angle with the respective center region, each rail being comprised of two longitudinally spaced rail sections each having a respective such center region flanked by a pair of the upwardly angled end regions; and respective flexible webs between the rail sections.

6. In combination with a conveyor having an array of rollers defining a transport plane, a pallet comprising:

supports forming an upwardly open saddle adapted to hold a coil of metal strip; and a pair of generally parallel and longitudinally extending rails underneath and fixed to the supports, each rail having a downwardly directed face adapted to ride directly on the rollers and having a generally planar center region and a pair of upwardly angled end regions each forming an obtuse angle with the respective center region, each rail having between the respective center region and each of the respective end regions an intermediate region forming with the respective center region an obtuse angle greater than the obtuse angle formed by the respective end region with the respective center region.

7. In combination with a conveyor having an array of rollers defining a transport plane, a pallet comprising:

supports forming an upwardly open saddle adapted to hold a coil of metal strip;

a pair of generally parallel and longitudinally extending rails underneath and fixed to the supports, each rail having a downwardly directed face adapted to ride directly on the rollers and having a generally planar center region and a pair of upwardly angled end regions each forming an obtuse angle with the respective center region, each rail being formed by a pair of longitudinally spaced skids each having a respective such center region flanked by a pair of the upwardly angled end regions;

a frame carrying the supports; and respective pivot joints supporting the skids on the frame for pivoting about respective transverse axes.

8. In combination with a conveyor having an array of rollers defining a transport plane, a pallet comprising:

supports forming an upwardly open saddle adapted to hold a coil of metal strip;

a pair of generally parallel and longitudinally extending rails underneath and fixed to the supports, each rail having a downwardly directed face adapted to ride directly on the rollers and having a generally planar center region and a pair of upwardly angled end regions each forming an obtuse angle with the respective center region;

a frame carrying the supports;

respective pivot joints at one longitudinal end of each of the rails for pivoting of the respective rail on the frame about a transverse axis; and respective slide joints at the opposite end of each of the rails for longitudinal sliding of the opposite rail ends on the frame.

* * * * *